United States Patent [19]

Laser

[11] 4,345,903

[45] Aug. 24, 1982

[54] FIN PROPULSION BOAT

[76] Inventor: Otto Laser, Zum Homberger Born 6, D-3546 Vöhl-Asel, Fed. Rep. of Germany

[21] Appl. No.: 152,995

[22] Filed: May 27, 1980

Related U.S. Application Data

[63] Continuation-in-part of Ser. No. 109,236, Jan. 3, 1980, abandoned, which is a continuation of Ser. No. 873,206, Jan. 30, 1978, abandoned.

[51] Int. Cl.[3] ..... B63H 25/06

[52] U.S. Cl. ..... 440/14; 440/21; 114/162; 114/140

[58] Field of Search ..... 416/81, 79, 82, 83; 440/14, 15, 13, 21, 24–27, 32; 114/162–164, 140, 144 R

[56] References Cited

U.S. PATENT DOCUMENTS

| | | | |
|---|---|---|---|
| 705,348 | 7/1902 | Hayes | 440/14 |
| 871,059 | 11/1907 | Douse | 440/15 |
| 2,062,546 | 12/1936 | Wells | 440/14 |
| 2,696,797 | 12/1954 | Whidden | 440/14 |
| 3,855,957 | 12/1974 | Gross | 440/15 |

*Primary Examiner*—Trygve M. Blix
*Assistant Examiner*—D. W. Keen
*Attorney, Agent, or Firm*—Hane, Roberts, Spiecens & Cohen

[57] ABSTRACT

A boat comprising a tread drive system including pedals which are adjustable to the size of the operator. An axle extends through the bottom of the boat at the center of the tread system and is connected for oscillating movement therewith, the axle carrying at its lower end a horizontal swing arm. A vertical fin is mounted on the free end of the swing arm for pivotal movement relative thereto. The fin is a flat rigid plate which is tiltable between angular stops. The fin widens rearwardly and is confined by top and bottom baffles. The fin is arranged beneath the center area of the boat between an aft stabilizing fin and a front fin acting as a rudder whose pivot bearing may be coaxial with that of the tiltable fin. The aft stabilizing fin corresponds in size and shape to the rudder and is rigidly fastened to the bottom of the boat near its stern, preferably underneath the seat area for the operator. The boat is steered by a horizontal tiller or steering wheel joined to the upper end of the rudder shaft. The diameter of the turning circle is generally less than twice the length of the boat.

11 Claims, 6 Drawing Figures

FIN PROPULSION BOAT

CROSS-RELATED APPLICATION

This application is a continuation-in-part of pending patent application Ser. No. 109,236 filed Jan. 3, 1980 (now abandoned) which is a continuation of Ser. No. 873,206 filed on Jan. 30, 1978 also now abandoned.

FIELD OF THE INVENTION

The invention relates to a fin propulsion and steering system for boats, particularly for small light-weight craft. The invention is especially suited for inflatable boats.

BACKGROUND OF THE INVENTION

Small water craft are known which have been propelled by single paddles, paddle-wheels, oars and the like, involving muscular effort. For greater ease of operation, oscillating propeller blades have also been used. The invention is concerned with such propulsion and steering devices.

PRIOR ART

U.S. Pat. No. 705,348 (Hayes) discloses, at the stern of a lifeboat in front of its rudder, an oscillating propeller the post lever of which can be reciprocated by winding and unwinding a cable when a power shaft is turned to operate a reversing gear. Resilient buffers held in tight bands on either side of the propeller serve as stop means to limit the lateral movement of the propeller which resembles a fish tail and is flexible, being made of a springy steel core enclosed in a metal sheathing.

In U.S. Pat. No. 871,059 (Douse) there is disclosed a marine vessel, such as a catamaran, having a front rudder that can be turned by a steering handle system, and further comprising a pedal-operated oscillating drive for the power shaft of a rear blade that is flexibly extended between bifurcated lobes near the boat's stern. The action of the propeller blade is intended to combine a sweeping and bending action such that each lateral stroke effects a forward impulse to the boat.

The boat propelling device of U.S. Pat. No. 2,062,546 (Wells), also comprises a power shaft near the stern of a boat. Underneath the bottom of the boat, a tapered propeller bar is attached to the end of the shaft and is provided with a pivotable extension that carries the propeller which, in turn, is pivotably arranged between elastic arms limiting the blade's angular movement. It is assumed that the device can be used as a steering means without interfering with its operation as an impeller.

A manual propelling and guiding mechanism as disclosed in U.S. Pat. No. 2,696,797 (Whidden) includes a pivotable "sneaker" blade which is a hinged and spring-biased rudder inclined about 45 degrees aft. A bent rod is secured to the horizontal shaft to which the blade is hinged, and rubber bumpers at either end of the bent rod produce rebound of the blade when it is actuated by a reciprocating movement imparted to the horizontal shaft. Springs connecting either rod end to the blade are said to kick it parallel to the horizontal bar so as to apply thrust to the boat.

Yet another self-propelled boat is disclosed in U.S. Pat. No. 3,855,957 (Gross) which utilizes a stern-mounted swim fin system with a foot-operated cross bar. If the latter is alternated, the propelling shaft will be reciprocated and will swing the fin. The fin is preferably flexible so that it will bend in a direction opposite to its angular movement, which is designed to propel and steer the boat at the same time.

It is seen that in the cited prior art, an elastically yielding propeller blade is pivotably arranged at or near the bottom of the stern of a boat that is to be impelled forwardly when the blade is swung to and fro. However, this well-known way of "wriggling" a boat affords much power at the primary side since a great deal of the force expended will act to shift and turn the boat, and each single stroke must immediately be counteracted by a stroke in the opposite direction in order to even remotely maintain a desired course. Moreover, not only will much of the primary energy thus be wasted, but also the maneuverability of such boat is rather poor as its bow is bound to yaw through wide deviation angles.

OBJECTS OF THE INVENTION

It is an object of the invention to provide an improved boat propulsion and steering system which requires little power due to increased efficiency and is adapted to be easily operated.

It is another object of the invention to provide an impelling and steering fin system for a boat such that its maneuverability is greatly enhanced.

A futher object of the invention is to provide a boat with steering and impelling fins of such construction and arrangement that the boat will maintain its course steadily even while the impeller fin is oscillated.

Still another object of the invention is to improve the fin propulsion and steering systems for trouble-free mounting and well-sealed attachment to small, low-weight craft such as inflatable boats, dinghies, catamarans and the like.

Yet another object of the invention is to provide a boat fin propulsion and steering system that is of a simple, sturdy structure which can be produced economically.

SUMMARY OF THE INVENTION

In a boat incorporating a tread system with pedals for applying foot power to a cross bar rigidly fastened to a pivot that extends through the boat bottom and carries, at its lower end, a substantially horizontal swing arm to the free end of which a vertical fin is mounted for limited lateral movement with respect to the swing arm, and further incorporating a front steering mechanism including a pivotable forward fin near the bow of the boat, the invention is characterized by the improvement wherein an aft stabilizing fin is rigidly attached to the boat bottom near the stern and wherein said vertical fin is arranged between said forward and aft fins. In particular, the invention provides for the axes of said forward and aft fins to be arranged at substantially equal spacings from the effective vertical central axis of the boat, with said pivot of said swing arm being preferably spaced from said effective vertical central axis by a distance substantially equal to the effective center range of said vertical fin.

A boat of such general construction is distinguished from the prior art in a number of ways. The forward and aft fins serve to stabilize the boat along its course and to reduce lateral drift while the power, efficiency and economy are greatly increased. As the vertical or impeller fin oscillates at a location between said forward and aft fins near the center of the boat, the impeller fin movement has no substantial influence on the boat's course and the power introduced is transformed into thrust to a hitherto unheard-of degree. Furthermore, relatively small but essentially equal distances of said swing arm's pivot to said effective vertical central axis of the boat and of the latter axis to the effective center of said vertical fin contribute greatly to the enormous maneuverability of the boat, since any steering torques will be increased, i.e. "geared up" whereas undesirable deviation torques will be reduced, i.e. "geared down" due to the lever arms.

FEATURES OF THE INVENTION

According to a first feature of the invention, the swing arm pivot is near the forward fin and the vertical fin is arranged in the vicinity of the aft fin, contributing to course stability and large overall efficiency of propulsion.

In a particular construction, the vertical fin is a flat rigid plate which is trapezoidal and widens rearwardly and includes top and bottom baffle means, the oscillating movement of the fin being limited by stops attached to the swing arm. This construction serves to reduce the induced flow impedance during propulsion, i.e. while the boat cruises. This is believed to be at least partly due to the trapezoidal shape of the fin, the baffles of which extend along straight lines that intersect the swing arm at the swing arm pivot. Thus, the flat rigid plate construction of said vertical fin and said top and bottom baffles provide for smooth laminar flow with an absolute minimum of turbulence.

The forward and aft fins are advantageously of the same construction which facilitates manufacture and servicing. Preferably, the components of the boat are all of lightweight materials such as plastic, rubber, lightweight alloys and the fins are preferably made of plastic with reinforcing inserts. Thereby, a small overall weight of the boat is obtained with little mass of inertia, which in combination with an equal spacing of the forward and aft fins from the central vertical axis of the boat leads to excellent mobility of the boat which can be turned around almost in place at full speed and immediately gain headway again.

DETAILED DESCRIPTION

Figure 1:
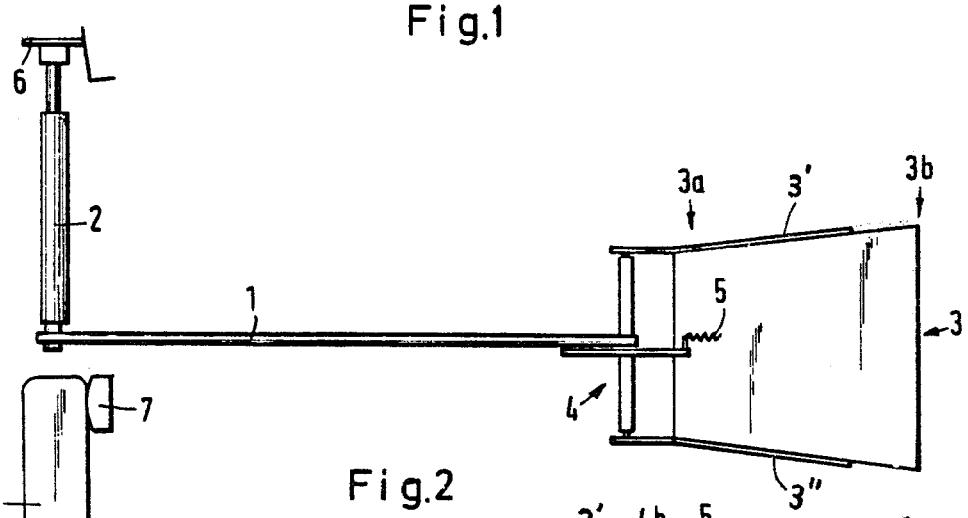
FIG. 1 is a side elevational view of one embodiment of a fin propulsion mechanism.
Figure 2:
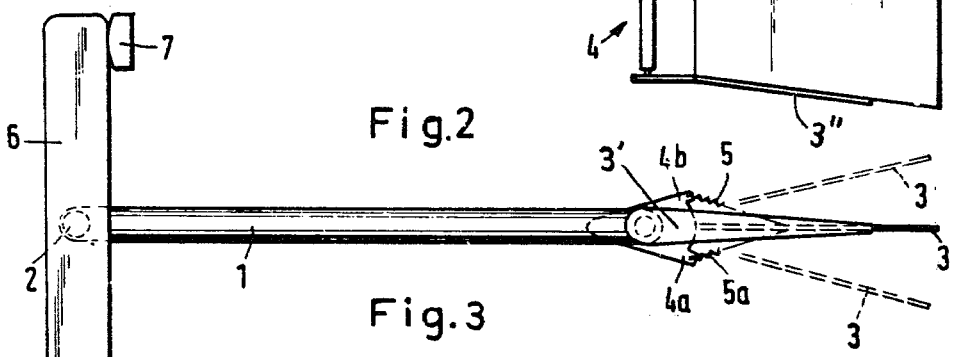
FIG. 2 is a top plan view of the mechanism of FIG. 1.

FIGS. 1 and 2 show a fin propulsion mechanism which comprises a horizontal swing arm 1 one end of which is secured to a pivot 2 for undergoing oscillating movement therewith when the pivot 2 is pivoted by means of a cross bar 6 attached to the top of the pivot. Pedals 7 and 8 at opposite ends of the cross bar 6, or at a parallel cross bar of a link system (not shown), permit a foot operation for reciprocating swing arm 1.

The free end of swing arm 1 carries a pivot 4 supporting a tiltable impeller fin 3 which is rigid and plane, thus enhancing laminar flow and optimum utilization of power. The fin resembles a fish tail in that it is trapezoidal and widens rearwardly such that at edge 3*b*, it is larger than at edge 3*a*. Swing arm 1 is provided with angular stops 4*a*, 4*b* for limiting the pivotal movement of the impeller fin 3 relative to swing arm 1, which pivotal movement is assisted by tension springs 5, 5*a* which may be extended between the angular stops 4*a*, 4*b* and the impeller fin 3. Inclined baffles 3′ and 3″ confine the impeller fin 3 at the top and bottom respectively, and the baffles are so inclined to intersect the swing arm at pivot 2. This serves to reduce turbulence due to induced flow impedance of the passing water under the propulsion effected by the oscillating movement of fin 3.

Figure 3:
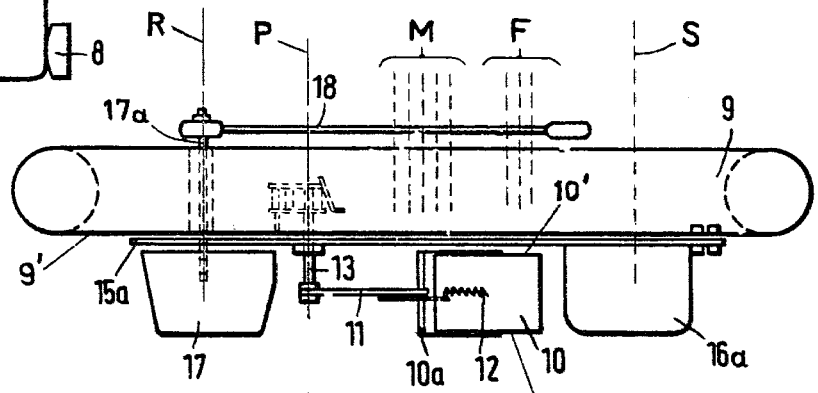
FIG. 3 is a side elevational view of a boat incorporating a fin propulsion and steering system according to the invention.
Figure 4:
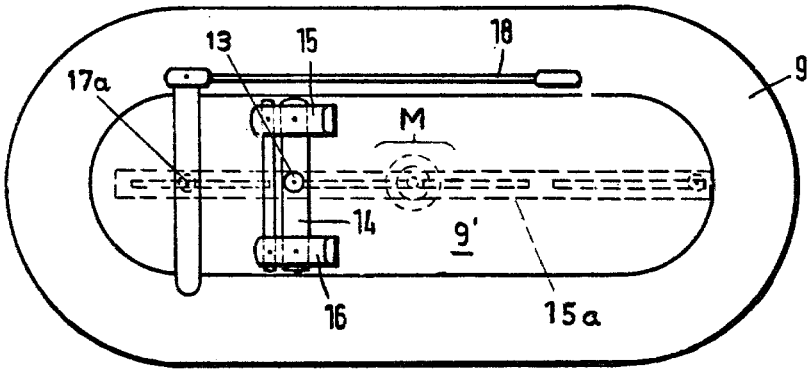
FIG. 4 is a top plan view of the boat shown in FIG. 3.

An amusement boat, generally designated by numeral 9, is shown in FIGS. 3 and 4. The boat incorporates a fin propulsion and steering system which includes impeller fin 10 which is tiltable around the axis of a pivot 10*a* attached to the free end of swing arm 11. This pivotal movement of the fin relative to the swing arm may be assisted by tension springs 12 connected to fin 10 and arm 11. Swing arm 11 is fastened to or integral with a pivot 13 extending through the bottom 9′ of boat 9 via a suitable seal means (not shown). Pivot 13 is rigidly fixed to a cross bar 14 or to a link system associated therewith. Pedals 15,16 are shiftably mounted on cross bar 14 or on a parallel bar of the link system to effect operation thereof by the feet of the user.

A stringer 15*a* is secured to the bottom 9′ of boat 9 and supports a bearing of pivot 13. An aft stabilizing fin 16 is rigidly fixed to stringer 15*a*. Also fixed to stringer 15*a* is a bearing for a forward pivot 17*a* of a forward fin 17 serving as a rudder. The fin 17 is operated by means of a horizontal tiller 18 or a steering wheel (not shown) connected to the upper end of the pivot 17*a*. Although in FIGS. 3 and 4, the bearings of pivots 13 and 17*a* are shown to be spaced apart, it is to be understood that they can be advantageously combined in a coaxial arrangement (not shown) so that a single sealed bushing in and through bottom 9′ will suffice.

It will be seen that the aft stabilizing fin 16*a*, the pivot 13 of swing arm 11 and the pivot 17*a* of forward fin 17 are mounted on stringer 15*a* and, therefore, are aligned along the longitudinal center line of the boat 9 (FIG. 4). It is an important feature of the invention that pivot axis R of the forward fin or rudder 17 and center line S of the rear stabilizing fin 16*a* are substantially equally spaced from the effective central axis M of boat 9 (FIG. 3), preferably near the bow and stern, respectively, so that the boat is stabilized along its course. The effective control axis M of the boat can be varied within a range both longitudinally as shown in FIG. 3 and radially as shown in FIG. 4. Any lateral drift is greatly reduced at the time and thus the overall power efficiency is correspondingly increased.

Another important feature of the invention resides in the mounting of the impeller fin 10 between the forward and aft fins, 17 and 16*a*, respectively. A particular arrangement may be such that axis P of pivot 13 is about equally spaced from the effective central axis M as the center of applied force F of the impeller fin 10. The center of applied force F can vary longitudinally within a small range as shown in FIG. 3. While the distance between the fins 16*a*, and 17 should be large and may be as great as feasible for a given boat structure, it is preferable to provide for small spacing between P and M as well as M and F in order that the lever arms acting on the boat 9 be optimum. The shorter the lever arms P-M and M-F, the less will the oscillating movement of impeller fin 10—which is limited by angular stops (not shown in FIGS. 3 and 4) on either side—influence the boat's straight course which is, moreover, held very stable due to the large spacing between R and S which also warrants large lever arms for maneuvering. Depending on the actual load of the boat, its trim, water flow and other parameters, any steering torques acting on the boat will become effectively "geared up" whereas any undesirable deviation torques will be "geared down", including the propelling oscillations. In a practical embodiment of an inflatable boat having an overall length of 2 meters, the diameter of a turning circle at full speed has thus been reduced to only 3 meters or 1.5 times the boat length.

The pivots, arms, bars and fittings such as bushings are preferably made of metal, in particular corrosion-resistant lightweight metal. The fins are advantageously made of soft plastic such as PVC (polyvinyl chloride) reinforced with rib inserts (not shown) so that they will be both yieldable and break-prool. For economy of manufacture and servicing, fins 16*a*, 17 may be identically constructed.

In operation, a person sits in the boat 9 on a seat such as an inflatable cushion (not shown) near the stern, with his feet in contact with pedals 15,16 while tiller 18 (or a steering wheel) is steered manually. Since the body of boat 9 is made of lightweight material such as plastic and the total weight of the fin propulsion and steering system can also be kept very low by the use of lightweight alloy elements, e.g. anodized aluminum and plastics, it is possible to construct the boat of low overall weight. Consequently, the mass of inertia is also small contributing to the boat's versatility. Surprisingly little power must be expended for propelling the boat which can be turned around almost in place and is, therefore, adapted for use even in very small swimming pools. As an example, one type of boat measures 1.9×1.0 meters and weighs 14 kilograms; when packed for transportation, the overall dimensions are 3'×2'×8". It will be evident that it can be conveniently shipped and quickly assembled.

Figure 5:
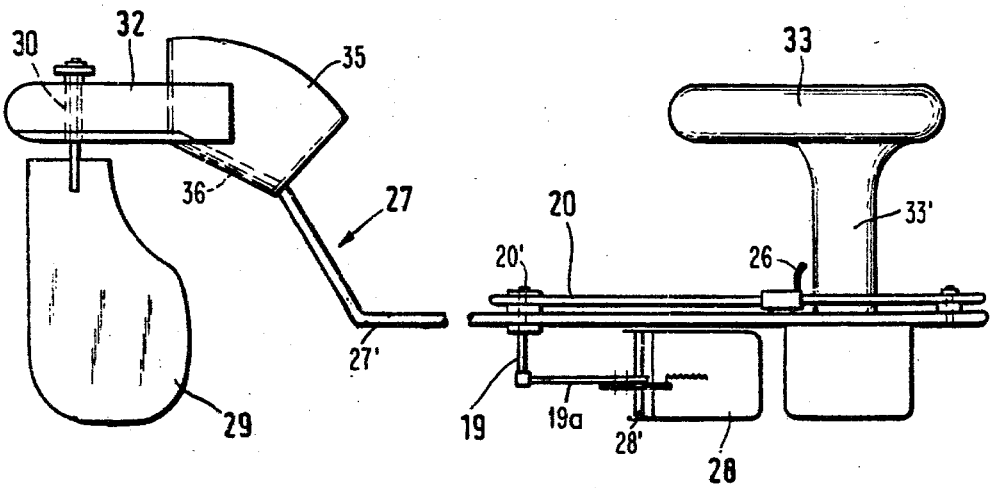
FIG. 5 is a side elevational view of a floating device comprising a fin propulsion and steering mechanism according to the invention.
Figure 6:
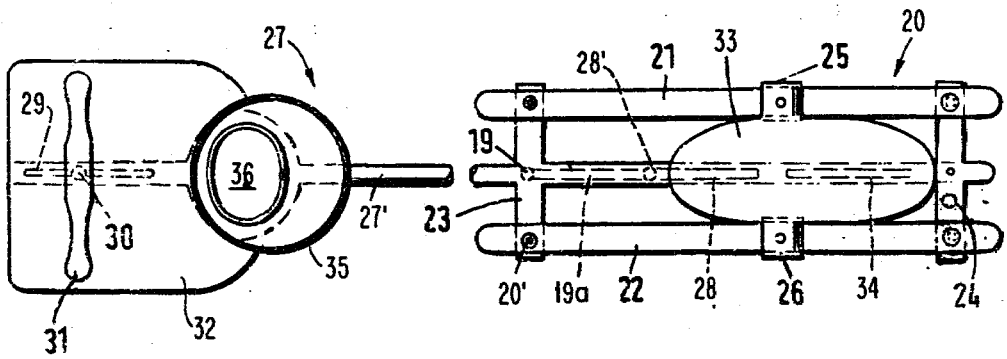
FIG. 6 is a top plan view of the floating device shown in FIG. 5.

A different embodiment and application of the invention is shown in FIGS. 5 and 6 comprising a floating device generally designated by numeral 27. The device 27 comprises a support 27' at opposite ends of which float chambers 32, 33 are attached. A pivot 19 supports, at its lower end, a swing arm 19*a* at whose free end there is mounted a further pivot 28' for an impeller fin 28. FIG. 5 shows angular stops firmly mounted on swing arm 19*a* for limiting the oscillating movement of impeller fin 28. This movement can be effected by means of a frame 20 or a four-bar linkage system that includes pivots 20' (of which only one is so designated in FIG. 6) for articulate connection of longitudinal struts 21, 22 parallel to support 27' with cross struts 23, 24. Secured on the longitudinal struts 21,22 are pedals 25 and 26, respectively, for foot operation of the four-bar linkage. Cross bar 23 is secured to pivot 19 and thereby drives the same in oscillation.

Underneath the rear float chamber 33, which "stands" on an upright 33', there is an aft stabilizing fin 34 rigidly connected to support 27'. At its front, support 27' is elevated so that the forward float chamber 32 directly attached thereto is substantially at the same level as the rear float chamber 33. A pivot 30 extends through the forward float chamber 32, and a forward fin 29 serving as a rudder is suspended by pivot 30. Behind the front float chamber 32 is a head rest 35 equipped with a viewing window 36.

In operation, a person rests, belly down, on the floating device 27, with his head and possibly his shoulders supported by head rest 35, while his feet contact pedals 25, 26 and his hands engage a steering arm 31 or tiller fastened to the upper end of pivot 30. This device enables a combined float-diving motion at full ease and without impeding breathing in the least. Here, too, the arrangement of the impeller fin 28 between the aft stabilizing fin 34 and the forward fin 29 serves to guarantee a maximum course stability and steering mobility. The point of attachment of pivot 19 to support 27' can again be made to correspond to the conditions elucidated above with respect to FIG. 3.

What is claimed is:

1. In a boat incorporating a tread system with pedals for applying foot power to a cross bar rigidly fastened to a pivot which extends through the boat bottom and carries, at its lower end, a substantially horizontal swing arm to the free end of which a vertical fin is mounted for limited lateral movement with respect to the swing arm, and further incorporating a front steering mechanism including a pivotable forward fin near the bow of the boat, the improvement comprising an aft stabilizing fin rigidly attached to the boat bottom near the stern thereof, said vertical fin being arranged between said forward and aft fins.

2. A boat according to claim 1, wherein said pivot of said swing arm is adjacent said forward fin such that said vertical fin at the end of said swing arm is capable of undergoing oscillating movement in front of said aft fin.

3. A boat according to claim 1, wherein said vertical fin comprises a flat rigid plate.

4. A boat according to claim 3, wherein said flat rigid plate widens vertically rearwards, said boat further comprising angular stop means attached to said swing arm for limiting oscillating movement of said vertical fin.

5. A boat according to claim 3, wherein said flat rigid plate includes top and bottom baffle means.

6. A boat according to claim 1, wherein said forward and aft fins are of identical construction, shape and size.

7. In a boat incorporating a tread system with pedals for applying foot power to a cross bar rigidly fastened to a pivot which extends through the boat bottom and carries, at its lower end, a substantially horizontal swing arm at the free end of which a vertical fin is mounted for limited lateral movement with respect to the swing arm, and further incorporating a front steering mechanism including a pivotable forward fin near the bow of the boat, the improvement comprising an aft stabilizing fin mounted below the boat bottom near the stern thereof, said forward and aft fins being substantially equally spaced from an effective vertical central axis of the boat, the vertical fin being arranged between the forward and aft fins.

8. A boat according to claim 7, wherein said pivot of said swing arm is spaced from said effective vertical central axis by a distance substantially equal to the spacing from said axis of the center of applied force of said vertical fin.

9. A boat according to claim 8, wherein the distance of the forward and aft fins to said effective vertical central axis is greater than the distance of the pivot axis of the swing arm to said effective vertical central axis.

10. A boat according to claim 7, wherein all components of the boat are made of lightweight materials, said forward and aft fins being made of plastic with reinforcing inserts.

11. A boat according to claim 1 or 7, wherein said pivots for the forward and vertical fins include bearings combined in a single coaxial bearing which passes via sealing means into the boat bottom.

* * * * *